United States Patent [19]

McGrady

[11] 4,321,166

[45] Mar. 23, 1982

[54] LIQUID DETERGENT COMPOSITIONS CONTAINING CORROSION INHIBITING SYSTEM

[75] Inventor: Joseph McGrady, Cincinnati, Ohio

[73] Assignee: The Procter & Gamble Company, Cincinnati, Ohio

[21] Appl. No.: 171,555

[22] Filed: Jul. 23, 1980

Related U.S. Application Data

[63] Continuation of Ser. No. 973,254, Dec. 26, 1978, abandoned.

[51] Int. Cl.[3] ..... C11D 3/28; C11D 1/83

[52] U.S. Cl. ..... 252/542; 252/117; 252/153; 252/548; 252/559

[58] Field of Search ..... 252/150, 153, 117, 392, 252/396, 542; 260/405.5, 407

[56] References Cited

U.S. PATENT DOCUMENTS

| | | | |
|---|---|---|---|
| 2,618,603 | 11/1952 | Schaffer | 252/110 |
| 2,618,604 | 11/1952 | Schaffer | 252/135 |
| 2,618,605 | 11/1952 | Schaffer | 252/526 |
| 2,618,606 | 11/1952 | Schaffer | 252/110 |
| 2,618,608 | 11/1952 | Schaffer | 252/526 |
| 3,769,242 | 10/1973 | Kelly et al. | 252/542 |
| 4,075,118 | 2/1978 | Gault | 252/135 |
| 4,079,078 | 4/1978 | Collins | 252/545 |

FOREIGN PATENT DOCUMENTS

| | | | |
|---|---|---|---|
| 51-81440 | 12/1976 | Japan . | |
| 1230582 | 5/1971 | United Kingdom | 252/150 |

OTHER PUBLICATIONS

"Empol 1022–Polymerized Fatty Acids, " Emeryfacts, Emery Industries, Inc., Copyright 1956.

*Primary Examiner*—P. E. Willis, Jr.
*Attorney, Agent, or Firm*—Robert B. Aylor; Thomas H. O'Flaherty; Richard C. Witte

[57] ABSTRACT

Described are unbuilt heavy-duty liquid detergent compositions containing, as an improved corrosion inhibiting system, a mixture of an aromatic triazole and an oligomeric olefinic fatty acid.

12 Claims, No Drawings

LIQUID DETERGENT COMPOSITIONS CONTAINING CORROSION INHIBITING SYSTEM

This is a continuation, of application Ser. No. 973,254 filed Dec. 26, 1978 now abandoned.

TECHNICAL FIELD

This invention relates to unbuilt heavy-duty liquid detergent compositions containing, as a corrosion inhibiting system, a mixture of an aromatic triazole and an oligomeric, olefinic fatty acid. The combination of these individual ingredients results in improved corrosion inhibition in washing machines exposed to dilute aqueous solutions of the heavy-duty liquid detergents.

BACKGROUND ART

It is desirable to include an anti-corrosion agent in detergent compositions to inhibit the corrosion and discoloration of metal wash baskets in automatic washing machines and to prevent the discoloration of fabrics which come in contact with the wash baskets.

Unbuilt heavy-duty liquid detergent compositions containing minor amounts of fatty acid corrosion inhibitors are known in the art. For example, see U.S. Pat. No. 4,075,118, issued to Gault et al on Feb. 21, 1978, and U.S. Pat. No. 4,079,078, issued to Collins on Mar. 14, 1978, the disclosures of which are incorporated hereby by reference.

The use of aromatic triazoles, including benzotriazole, as corrosion inhibiting agents is also known in the art. U.S. Pat. Nos. 2,618,606 and 2,618,608, granted to Schaeffer on Nov. 18, 1952, incorporated herein by reference, disclose their use primarily in built detergent compositions, although they are also said to be effective in unbuilt detergent compositions.

The present invention embodies an improved corrosion inhibiting system, consisting essentially of a mixture of an aromatic triazole and an oligomeric $C_{14}$–$C_{22}$ olefinic fatty acid, for use in unbuilt heavy-duty liquid detergent compositions. It has been discovered that the combination of these corrosion inhibiting agents results in greater corrosion inhibition than that provided by each individual agent.

It is an object of this invention to provide stable unbuilt liquid detergent compositions which exhibit excellent pretreatment and through-the-wash fabric cleaning while delivering improved corrosion inhibition in automatic washing machines.

SUMMARY OF THE INVENTION

The present invention encompasses an unbuilt liquid detergent composition comprising from about 20% to about 75% of a detergent surfactant; from about 1.0% to about 75% of water; and from about 0.85% to about 2.0% of a corrosion inhibiting system consisting essentially of a mixture of an oligomeric $C_{14}$–$C_{22}$ olefinic fatty acid and an aromatic triazole, wherein the weight ratio of the fatty acid to the aromatic triazole is from about 40:1 to about 1:1.

DISCLOSURE OF THE INVENTION

This invention embodies an improved corrosion inhibiting system for use in unbuilt heavy-duty liquid detergent compositions. The corrosion inhibiting system consists essentially of a mixture of an aromatic triazole and an oligomeric $C_{14}$–$C_{22}$ olefinic fatty acid.

The detergent compositions described herein are free of conventional detergent builders. Specifically, they are substantially free of: inorganic alkaline detergent builder salts, such as alkali metal borates, phosphates, polyphosphates, tripolyphosphates, and silicates, and preferably are also free of alkali metal carbonates, bicarbonates and sulfates; organic alkaline detergency builder salts, such as water-soluble amino polyacetates, water-soluble salts of phytic acid, and water-soluble polyphosphonates; and insoluble aluminosilicate-type builder salts.

The unbuilt liquid detergent compositions of the present invention comprise three essential elements: a detergent surfactant, a corrosion inhibiting system, and water.

THE DETERGENT SURFACTANT

The unbuilt liquid detergent compositions of this invention comprise from about 20% to about 75% by weight, preferably from about 30% to about 60% by weight, and more preferably from about 40% to about 50% by weight, of a water-soluble detergent surfactant. Suitable detergent surfactants are anionic, nonionic, zwitterionic, semi-polar, and ampholytic surfactants, and mixtures thereof, which are more fully described in U.S. Pat. No. 4,075,118, Gault et al, and in U.S. Pat. No. 4,079,078, Collins, both of which are incorporated hereinabove by reference. Preferred are anionic surfactants, nonionic surfactants, and mixtures thereof, as hereinafter described.

Nonionic surfactants for use herein comprise the typical nonionic surface active agents well known in the detergency arts. Such materials can be succinctly described as the condensation products of an alkylene oxide (hydrophilic in nature), especially ethylene oxide (EO), with an organic hydrophobic compound, which is usually aliphatic or alkyl aromatic in nature. The length of the hydrophilic (i.e., polyoxyalkylene) moiety which is condensed with any particular hydrophobic compound can be readily adjusted to yield a water-soluble compound having the desired degree of balance between hydrophilic and lipophilic elements, i.e., the "HLB".

The HLB of the ethoxylated nonionics used herein can be experimentally determined in well-known fashion, or can be calculated in the manner set forth in Decker, EMULSIONS THEORY AND PRACTICE, Reinhold 1965, pp. 233 and 248. For example, the HLB of the nonionic surfactants herein can be simply approximated by the term: $HLB=E/5$; wherein E is the weight percentage of ethylene oxide content in the molecule. Of course, the HLB will vary, for a given hydrocarbyl content, with the amount of ethylene oxide.

Preferred nonionic surfactants for use in the present compositions and processes are characterized by an HLB in the range of from 9 to 20, most preferably 10 to 14.

Specific, nonlimiting examples of suitable water-soluble nonionic surfactants include the following.

The ethylene oxide condensates of alkyl phenols are a well-known type of water-soluble ethoxylated nonionic surfactant. These compounds include the condensation products of alkyl phenols having an alkyl group containing from about 6 to 18 carbon atoms in either a straight chain or branched chain configuration, with EO, said EO being present in amounts from about 1 to about 25 moles of EO per mole of alkyl phenol. The alkyl substituent in such compounds can be derived, for example, from polymerized propylene, di-isobutylene, octene, or nonene. Examples of compounds of this type include nonyl phenol condensed with about 9.5 moles of EO per mole of nonyl phenol; dodecyl phenol condensed with about 12 moles of EO per mole of phenol; dinonyl phenol condensed with about 15 moles of EO per mole of phenol; and di-isooctylphenol condensed with about 15 moles of EO per mole of phenol. Commercially available nonionic surfactants of this type include Igepal CO-630, marketed by the GAF Corporation, and Triton X-45, X-114, X-100 and X-102, all marketed by the Rohm and Haas Company.

The condensation products of aliphatic alcohols with 1 to 20 moles of ethylene oxide are another (and highly preferred) type of nonionic surfactant used herein. The alkyl chain of the aliphatic alcohol can be either straight or branched, and generally contains from about 8 to about 22, preferably 9 to 16, carbon atoms. The alcohols can be primary, secondary, or tertiary. Examples of such ethoxylated alcohols include the condensation product of about 6 moles of EO with 1 mole of tridecanol; myristyl alcohol condensed with about 10 moles of EO per mole of myristyl alcohol; the condensation product of EO with coconut fatty alcohol wherein the coconut alcohol is primarily a mixture of fatty alcohols with alkyl chains varying from 10 to about 14 carbon atoms in length and wherein the condensate contains about 6 moles of EO per mole of total alcohol; and the condensation product of about 9 moles of EO with the above-described coconut alcohol. Tallow alcohol ethoxylates $(EO)_6$ to $(EO)_{11}$ are similarly useful herein. Examples of commercially available nonionic surfactants of the foregoing type include Tergitol 15-S-9, marketed by the Union Carbide Corporation; Neodol 23-6.5, marketed by the Shell Chemical Company; and Kyro EOB, marketed by The Procter & Gamble Company.

The condensation products of ethylene oxide with a hydrophobic base formed by the condensation of propylene oxide with propylene glycol constitute another type of nonionic surfactant. The hydrophobic portion of these compounds has a molecular weight of from about 1500 to 18,000 and, of course, exhibits water insolubility. The addition of poly-EO moieties to this hydrophobic portion tends to increase the water-solubility of the molecule as a whole, and the liquid character of the product is retained up to the point where the EO content is about 50% of the total weight of the condensation product. Examples of compounds of this type include certain of the commercially available Pluronic surfactants, marketed by BASF Wyandotte.

The condensation products of ethylene oxide with the product resulting from the reaction of propylene oxide and ethylenediamine are another type of nonionic surfactant useful herein. The hydrophobic "base" of these condensation products consists of the reaction product of ethylenediamine and excess propylene oxide, said base having a molecular weight of from about 2500 to about 3000. This base compound is thereafter condensed with EIO to the extent that the condensation product contains from about 40% to about 80% by weight of poly-EO and has a molecular weight of from about 5,000 to about 11,000. Examples of this type of nonionic surfactants include certain of the commercially available Tetronic compounds, marketed by BASF Wyandotte.

The highly preferred nonionic surfactants herein include the $EO_1$–$EO_{20}$ condensates of $C_9$ to $C_{18}$ primary and secondary alcohols; the condensates of primary alcohols are most preferred. Nonlimiting, specific examples of nonionic surfactants of this type are as follows (the abbreviations used for the nonionic surfactants, e.g., $C_{14}(EO)_6$, are standard for such materials and describe the carbon content of the lipophilic portion of the molecule and the ethylene oxide content of the hydrophilic portion): n-$C_{14}H_{29}(EO)_5$; n-$C_{14}H_{29}(EO)_6$; n-$C_{14}H_{29}(EO)_7$; n-$C_{14}H_{29}(EO)_{10}$; n-$C_{15}H_{31}(EO)_6$; n-$C_{15}H_{31}(EO)_7$; 2-$C_{15}H_{31}(EO)_7$; n-$C_{15}H_{31}(EO)_8$; 2-$C_{15}H_{31}(EO)_8$; n-$C_{15}H_{31}(EO)_9$; 2-$C_{15}H_{31}(EO)_9$; n-$C_{16}H_{33}(EO)_9$; and 2-$C_{16}H_{33}(EO)_9$.

It is to be recognized that mixtures of the foregoing nonionic surfactants are also useful herein and are readily available from commercial alcohol mixtures.

It will be appreciated that the degree of ethoxylation in the nonionics listed herein can vary somewhat, inasmuch as average fractional degrees of ethoxylation occur. For example, n—$C_{15}H_{31}(EO)_7$ can contain small quantities of n-$C_{15}H_{31}(EO)_0$ and n—$C_{15}H_{31}(EO)_{14}$. Commercial mixtures will contain portions of materials of varying EO contents, and the stated EO content represents an average. Such mixtures are quite suitable for use in the present compositions and processes.

Highly preferred alcohol-based nonionic surfactants are the $C_{14-15}(EO)_{6-9}$ materials disclosed hereinabove, which are commercially available as mixtures under the names Neodol 45-7 and Neodol 45-9 from the Shell Chemical Co. Neodol 45-7 is a liquid at ambient temperatures (and is preferred herein for that reason) whereas Neodol 45-9 is a solid at room temperature. However, solid nonionics such as Neodol 45-9 are also useful in the instant liquid compositions inasmuch as they readily dissolve therein. Other highly preferred nonionics include Dobanol 91-8 ("OXO"-based alcohol from Shell) and Softanol, available from Nippon Shokubei.

When using commercial nonionic mixtures, especially of lower ($C_9$–$C_{10}$) alkyl chain length, it is preferred that the unethoxylated alcohols and lower $(EO)_1$-$(EO)_2$ ethoxylates be removed, or "stripped", to reduce undesirable odors. Stripping can be done in vacuo or by standard distillation means.

The preferred nonionic materials herein are alcohols having a carbon content of from $C_9$ to about $C_{18}$ condensed with from about 2 (avg.) moles to about 12 (avg.) moles of ethylene oxide per mole of alcohol, and further characterized by an HLB within the range of from about 8 to about 15, preferably from about 9 to about 14. Nonionic surfactants falling within these ranges are highly preferred herein from the standpoint of optimal pre-treatment cleansing, optimal through-the-wash cleansing and product stability.

Other useful nonionic surfactants include those described in U.S. Pat. No. 3,963,649, Spadini et al, issued on June 15, 1976, incorporated herein by reference. These include water-soluble tertiary amine oxides; water-soluble tertiary phosphine oxides; water-soluble amides; and other water-soluble condensation products, obtained by condensing from about 1 to about 25 moles of ethylene oxide with one mole or organic, hydrophobic compound, aliphatic or alkyl aromatic in nature, having 8 to 24 carbon atoms, and at least one reactive hydrogen atom, preferably a reactive hydroxyl, amino, amido, or carboxy group. General examples of these condensation products, along with those discussed earlier, include the condensates of ethylene oxide with fatty acid esters; polyethenoxy esters or esters obtained by reacting ethylene oxide with carboxylic acids; condensation products of fatty acyl alkanolamides with ethylene oxide; and condensation products of $C_8$–$C_{18}$ alkyl, $C_8$–$C_{18}$ alkenyl and $C_5$–$C_{18}$ alkylaryl amines and ethylene oxide.

Anionic surfactants useful herein can be an organic sulfuric reaction product having in its molecular structure an alkyl, aryl, alkaryl or aralkyl group containing from about 6 to about 22 carbon atoms and a sulfonic acid or sulfuric acid ester group, or mixtures thereof. (Included in the term "alkyl" is the alkyl portion of acyl groups). Examples of this group of synthetic detersive surfactants which can be used in the present invention are the alkyl sulfates, especially those obtained by sulfating the higher alcohols ($C_8$–$C_{18}$ carbon atoms) produced from the glycerides of tallow or coconut oil; and alkylbenzene sulfonates, in which the alkyl group contains from about 9 to about 15 carbon atoms, in straight chain or branched chain configuration, e.g., those of the type described in U.S. Pat. Nos. 2,220,099 and 2,477,383, incorporated herein by reference. Linear straight chain alkyl benzene sulfonates in which the average of the alkyl groups is about 13 carbon atoms, abbreviated as $C_{13}$LAS as well as mixed $C_{11.2}$ and $C_{11.8}$ (avg.) LAS are typically used. $C_{11}$–$C_{14}$ branched chain alkylbenzene sulfonates (ABS), which are excellent sudsers, can also be used.

Examples of commercially available alkylbenzene sulfonates (free acid form) useful in the instant invention include Conoco SA 515, SA 597, and SA 697, all marketed by the Continental Oil Company, and Calsoft LAS 99, marketed by the Pilot Chemical Company.

Other anionic surfactant compounds herein include the alkyl glyceryl ether sulfonates, especially those ethers of higher alcohols derived from tallow and coconut oil; coconut oil fatty acid monoglyceride sulfonates and sulfates; and alkyl phenol ethylene oxide ether sulfates containing about 1 to about 10 units of ethylene oxide per molecule and wherein the alkyl groups contain about 8 to about 12 carbon atoms.

Other useful anionic surfactants herein include the esters of alpha-sulfonated fatty acids containing from about 6 to 20 carbon atoms in the ester group; 2-acyloxyalkane-1-sulfonic acids containing from about 2 to 9 carbon atoms in the acyl group and from about 9 to about 23 carbon atoms in the alkane moiety; alkyl ether sulfates containing from about 10 to 20 carbon atoms in the alkyl group and from about 1 to 30 moles of ethylene oxide; olefin sulfonates containing from about 12 to 24 carbon atoms; and beta-alkyloxy alkane sulfonates containing from about 1 to 3 carbon atoms in the alkyl group and from about 8 to 20 carbon atoms in the alkane moiety.

Anionic surfactants based on the higher fatty acids, i.e., "soaps" are useful anionic surfactants herein. Higher fatty acids containing from about 8 to about 24 carbon atoms and preferably from about 10 to about 20 carbon atoms are useful anionic surfactants in the present compositions. Particularly useful are the soaps derivable from the mixtures of fatty acids made from coconut oil and tallow.

Preferred water-soluble anionic organic surfactants herein include linear and branched alkylbenzene sulfonates containing from about 10 to about 18 carbon atoms in the alkyl group; the tallow range alkyl sulfates; the coconut range alkyl glyceryl sulfonates; alkyl ether (ethoxylated) sulfates wherein the alkyl moiety contains from about 12 to 18 carbon atoms and wherein the average degree of ethoxylation varies between 1 and 12, especially 3 to 9; the sulfated condensation products of tallow alcohol with from about 3 to 12, especially 6 to 9, moles of ethylene oxide; olefin sulfonates containing from about 14 to 16 carbon atoms; and soaps, as hereinabove defined.

Specific preferred anionics for use herein include; the linear $C_{10}$–$C_{14}$ alkylbenzene sulfonates (LAS); the branched $C_{10}$ to $C_{14}$ alkylbenzene sulfonates (ABS); the tallow alkyl sulfates, the coconut alkyl glyceryl ether sulfonates; the sulfated condensation products of mixed $C_{10}$–$C_{18}$ tallow alcohols with from about 1 to about 14 moles of ethylene oxide; and the mixtures of higher fatty acids containing from 10 to 18 carbon atoms.

It is to be recognized that any of the foregoing anionic surfactants can be used separately herein or as mixtures. Moreover, commercial grades of the surfactants can contain moninterfering components which are processing by-products. For example, commercial $C_{10}$–$C_{14}$ alkaryl sulfonates can comprise alkylbenzene sulfonates, alkyl toluene sulfonates, alkyl naphthalene sulfonates and alkyl poly-benzenoid sulfonates. Such materials and mixtures thereof are fully contemplated for use herein.

The anionic detergents can be used in the form of their sodium; potassium, ammonium; mono-, di-, or triethanolammonium; calcium; or magnesium salts, or mixtures thereof. Mixtures of anionic detergents are desirable. Sodium and magnesium salts are preferred and magnesium salts are most preferred.

Especially preferred as a surfactant system is a mixture of a nonionic surfactant produced by the condensation of from about 5 moles to about 11 moles of ethylene oxide with one mole of a $C_{13}$ to $C_{16}$ alcohol, said nonionic surfactant being characterized by an HLB of from about 9.5 to about 15; and an anionic surfactant which is a mixture of an alkanolamine and an alkali metal salt of an alkylbenzene sulfonic acid where the alkyl group contains from about 9 to about 15 carbon atoms and wherein said alkanolamine is selected from the group consisting of mono-, di-, and triethanolamines and said alkali metal is selected from the group consisting of sodium, potassium, magnesium, and calcium; at a weight ratio of nonionic surfactant to anionic surfactant of from about 1.8:1 to about 3.5:1 based on the free acid form of the anionic surfactant of from about 1.8:1 to about 3.5:1 based on the free acid form of the anionic surfactant. Even more preferably, the nonionic surfactant is a condensate of from about 6 to 9 moles of ethylene oxide with a $C_{14-15}$ alcohol and has an HLB within the range of 11 to 13, and the anionic surfactant is a mixture of the above-described alkanolamines and the alkali metal salts of a $C_{10-13}$ alkylbenzene sulfonic acid.

THE CORROSION INHIBITING SYSTEM

As a second essential element, the instant compositions comprise from about 0.85% to about 2.0% by weight, preferably from about 1.00% to about 1.5% by weight, of a corrosion inhibiting system. The corrosion inhibiting system consists essentially of a mixture of an oligomeric $C_{14}$–$C_{22}$ olefinic fatty acid and an aromatic triazole, wherein the weight ratio of the fatty acid to the aromatic triazole is from about 40:1 to about 1:1, and preferably is from about 20:1 to about 5:1. As used herein, it is intended that the carboxylate groups of the oligomeric olefinic fatty acids remain intact at the end of their respective chains. The structure of the oligomeric $C_{14}$–$C_{22}$ olefinic fatty acids of interest herein are believed to be similar to those described in a publication entitled "Empol® Dimer and Trimer Acids", Copyright 1971, by Emery Industries, Inc. incorporated herein by reference. The dimer and trimer acids are described as follows:

A "pure" dimer acid is an aliphatic, dibasic acid whose structure (see schematic below) is essentially that of a long-chain dicarboxylic acid with two alkyl side chains ($R_3$ and $R_4$). The structure contains at least one ethylenic bond and another linkage (X) resulting from the polymerization of the two unsaturated fatty acid molecules that form dimer acid.

Schematic Structural Formula of Dimer Molecule

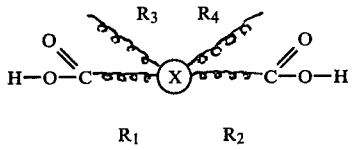

"Pure" trimer acid is a lon-chain tricarboxylic acid whose structure is shown schematically below. The structure of trimer acid is similar to that of dimer acid, but accordingly more complex due to the additional carbon atoms which it contains. Trimer acid has three or more alkyl side chains and two linkages at X in addition to at least one ethylenic bond.

Schematic Structural Formula of Trimer Molecule

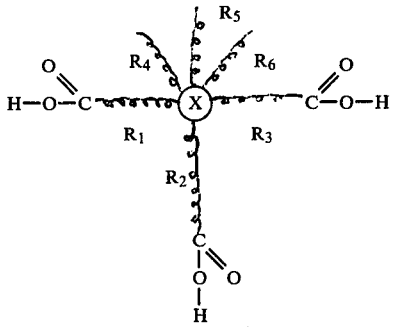

In a preferred embodiment of this invention, the fatty acid in the corrosion inhibiting system is selected from the group consisting of trimeric $C_{14}$–$C_{22}$ olefinic fatty acids, dimeric $C_{14}$–$C_{22}$ olefinic fatty acids, and mixtures thereof; and more preferably is a trimeric $C_{18}$ olefinic fatty acid, which is commercially available as Empol 1054 from Emery Industries.

Further, the term "aromatic triazole" is also intended to describe substituted aromatic triazoles, wherein one or more of the hydrogen atoms in the aromatic triazole is replaced with a halogen atom, particularly chlorine or bromine, with hydroxy, straight and branched chain $C_1$–$C_4$ alkyl, hydroxyalkyl, alkenyl, and alkaryl moieties, or with $$O{=}\overset{|}{C}{-}R,$$

wherein R is selected from the group consisting of hydrogen, hydroxy, a halogen atom, particularly chlorine or bromine, straight and branched chain $C_1$–$C_4$ alkyl, hydroxyalkyl, alkenyl, and alkaryl moieties.

As a preferred embodiment of the present invention, the aromatic triazole in the corrosion inhibiting system is selected from the group consisting of benzotriazole, tolyltriazole, acylated benzotriazoles, naphthotriazole, and mixtures thereof; and more preferably is selected from the group consisting of benzotriazole, tolyltriazole, and mixtures thereof.

In a particularly preferred embodiment of the present invention, the corrosion inhibiting system consists essentially of a mixture of a trimeric $C_{18}$ olefinic fatty acid and benzotriazole in a weight ratio of the fatty acid to the benzotriazole of from about 20:1 to about 5:1.

WATER

Water, in an amount of from about 1.0% to about 75%, preferably from about 10% to about 65%, most preferably from about 25% to about 50%, by weight of the unbuilt detergent composition, is a third essential element of this invention.

OPTIONAL INGREDIENTS

Other components conventionally found in unbuilt heavyduty liquid detergent compositions, which are more fully described in U.S. Pat. Nos. 4,075,118 and 4,079,078, incorporated hereinabove by reference, can be included in the instant compositions. More specifically, these optional components can include alkanolamine compounds, alkali metal bases, alcohol solvents, electrolyte salts, color stabilizing agents, suds modifying agents, fabric softeners, static control agents, soil suspending agents, soil release agents, germicides, pH adjusting agents, hydrotropes, perfumes, brighteners, flourescers, enzymes, bleaching agents, bleach activators, anti-microbial agents and coloring agents.

The corrosion inhibiting mixture can be incorporated into the unbuilt detergent compositions of the present invention as the final ingredient, or earlier during the processing of the detergent compositions. The corrosion inhibiting agents can also be added separately to the detergent compositions described herein.

While not intending to be limited by theory, it is believed that the aqueous insolubility of the fatty acids described herein and their ability to complex with cations of the metal surfaces of washing machine tubs results in their adsorption onto these surfaces, forming a protective film or coating over them. Surprisingly, the fatty acid materials are attracted to the surfaces to provide their corrosion inhibiting benefits even in the presence of high concentrations of nonionic surfactants and alkylbenzene sulfonates of the type disclosed hereinabove which, themselves, are extremely effective in removing greasy and fatty-based materials from surfaces. Additionally, the aromatic triazole compounds are believed to form chemical complexes with divalent cations, particularly with nickel present in the wash baskets, thus adding to the protective film. It is also presumed that chelation at the surfaces of the machine tub, probably with iron, results in the formation of another protective film. These protective films are believed to restrict the access of oxygen and other corrosive ingredients to the metal surface.

As used herein, all percentages, parts and ratios given are "by weight", unless otherwise specified.

The following nonlimiting examples illustrates the compositions of the present invention.

EXAMPLE I

The following unbuilt storage-stable liquid detergent composition was produced:

| Component | Wt. % |
|---|---|
| Composition A | |
| $C_{14-15}(EO)_7$* | 15.0 |
| Magnesium $C_{14}$ linear alkyl benzene sulfonate | 30.0 |
| Ethanol | 6.5 |
| Triethanolamine | 3.0 |
| Monoethanolamine | 0.45 |
| Trimeric $C_{18}$ olefinic fatty acid | 1.0 |
| Benzotriazole | 0.05 |
| Citric acid | 0.1 |
| Perfume, brightener, dye | 1.22 |
| Water | 42.68 |
| (pH = 8.4) | 100.00 |

*Condensation product of $C_{14-15}$ alcohol with 7 moles of ethylene oxide, commercially available as Neodol 45-7, from Shell Chemical Corporation.
[1]Empol 1054, commercially available from Emery Industries.

The above composition provided excellent fabric cleaning when used either full strength as a pretreatment or for through-the-wash detergency at a level of about ¼ cup usage per 17 gallons of wash water. Moreover, the composition was stable and provided a corrosion inhibition effect to the steel surface of a washing machine wherein the composition was used. The corrosion inhibition provided by the combination of the benzotriazole and the trimeric $C_{18}$ olefinic fatty acid was greater than that provided by each individual corrosion inhibiting element, as will be demonstrated by the following example.

Substantially similar corrosion inhibiting benefits are obtained when the benzotriazole is replaced with other substituted aromatic triazoles, especially when replaced with tolyltriazole, acylated benzotriazoles, naphthotriazole, and mixtures thereof.

Substantially similar corrosion inhibiting benefits are obtained when the trimeric $C_{18}$ olefinic fatty acid is replaced with other oligomerized $C_{14}$–$C_{22}$ olefinic fatty acids (such as dimerized $C_{18}$ olefinic fatty acid, dimerized $C_{16}$ olefinic fatty acid, dimerized $C_{20}$ olefinic fatty acid, trimerized $C_{16}$ olefinic fatty acid and trimerized $C_{20}$ olefinic fatty acid) and mixtures thereof.

Substantially similar corrosion inhibiting benefits are obtained when the anionic/nonionic surfactant mixture of Composition A is replaced with other detergent surfactants selected from the group consisting of nonionic surfactants, anionic surfactants and mixtures thereof; especially when replaced with any mixture of a nonionic surfactant produced by the condensation of from about 5 moles to about 11 moles of ethylene oxide with one mole of a $C_{13}$ to $C_{16}$ alcohol, said nonionic surfactant being characterized by an HLB of from about 9.5 to about 15; and an anionic surfactant which is a mixture of an alkanolamine and an alkali metal salt of an alkylbenzene sulfonic acid where the alkyl group contains from about 9 to about 15 carbon atoms and wherein said alkanolamine is selected from the group consisting of mono-, di-, and triethanolamines and said alkali metal is selected from the group consisting of sodium, potassium, magnesium, and calcium; at a weight ratio of nonionic surfactant to anionic surfactant of from about 1.8:1 to about 3.5:1 based on the free acid form of the anionic surfactant.

EXAMPLE II

The following unbuilt storage-stable liquid detergent compositions were produced:

| Component | Wt. % |
|---|---|
| Composition B (Control) | |
| $C_{14-15}(E0)_7$* | 15.0 |
| Linear alkylbenzene sulfonic acid | 30.2 |
| Magnesium hydroxide | 2.7 |
| Ethanol | 6.5 |
| Triethanolamine | 3.0 |
| Monoethanolamine | 0.36 |
| Trimeric $C_{18}$ olefinic fatty acid | 1.0 |
| Citric acid | 0.1 |
| Perfume, brightener, dye | 1.08 |
| Water | 40.06 |
| (pH = 8.2) | 100.00 |
| Composition C (Control) | |
| $C_{14-15}(EO)_7$* | 15.0 |
| Linear alkylbenzene sulfonic acid | 30.2 |
| Magnesium hydroxide | 2.7 |
| Ethanol | 6.5 |
| Triethanolamine | 2.5 |
| Benzotriazole | 0.9 |
| Citric acid | 0.1 |
| Perfume, brightener, dye | 1.08 |
| Water | 41.02 |
| (pH = 7.5) | 100.00 |

*Commercially available as Neodol 45-7

Compositions A (from Example I), B, and C were used in separate Kenmore washing machines equipped with 1976 Stipple wash baskets (which have representative porcelain finishes) at a level of about ¼ cup usage per 17 gallons of wash water. The water hardness was about 5 grains per gallon (mixed calcium and magnesium) and the wash temperature was about 130° F. Rust cells visible on the interior of the wash basket of the washing machines were counted after a certain number of wash cycles, using the above-described detergent compositions. The results were as follows:

| Cycles | Rust Cells |
|---|---|
| Composition A | |
| 32 | 11 |
| 96 | 56 |
| 130 | 61 |
| 200 | 137 |
| 312 | 145 |
| 443 | 206 |
| 539 | 221 |
| 648 | 234 |
| 792 | 263 |
| 902 | 408 |
| Composition B | |
| 157 | 845 |
| Composition C | |
| 40 | 49 |
| 184 | 322 |

The results demonstrate that Composition A, containing the combination of benzotriazole and trimeric $C_{18}$ olefinic fatty acid, has corrosion inhibition properties which are clearly superior to those of Compositions B and C, which contain the individual corrosion inhibiting elements.

What is claimed is:

1. An unbuilt detergent composition comprising from about 20% to about 75% of a detergent surfactant; from about 1.0% to about 75% of water; and from about 0.85% to about 2.0% of a corrosion inhibiting system consisting essentially of a mixture of an oligomeric $C_{14}$–$C_{22}$ olefinic fatty acid and an aromatic triazole selected from the group consisting of benzotriazole, naphthotriazole, compounds in which at least one of the hydrogen atoms in benzotriazole or naphthotriazole is replaced with a substituent each of which is selected from the group consisting of a halogen atom, hydroxy, straight and branched chain $C_1$–$C_4$ alkyl, hydroxyalkyl, and alkenyl groups and $$O{=}\overset{|}{C}{-}R,$$

wherein R is selected from the group consisting of hydrogen, hydroxy, a halogen atom, and straight and branched chain $C_1$–$C_4$ alkyl, hydroxyalkyl, and alkenyl groups, and mixtures thereof, wherein the weight ratio of the fatty acid to the aromatic triazole is about 20:1.

2. The composition of claim 1 comprising from about 1.00% to about 1.5% of said corrosion inhibiting system.

3. The composition of claim 1 wherein the fatty acid is selected from the group consisting of trimeric $C_{14}$–$C_{22}$ olefinic fatty acids, dimeric $C_{14}$–$C_{22}$ olefinic fatty acids, and mixtures thereof.

4. The composition of claim 3 wherein the fatty acid is a trimeric $C_{18}$ olefinic fatty acid.

5. The composition of claim 1 wherein the aromatic triazole is selected from the group consisting of benzotriazole, tolyltriazole, acylated benzotrizoles, naphthotriazole, and mixtures thereof.

6. The composition of claim 5 wherein the aromatic triazole is selected from the group consisting of benzotriazole, tolyltriazole, and mixtures thereof.

7. The composition of claim 1 comprising from about 30% to about 60% of the detergent surfactant.

8. The composition of claim 7 comprising from about 40% to about 50% of the detergent surfactant.

9. The composition of claim 1 wherein the detergent surfactant is selected from the group consisting of nonionic surfactants, anionic surfactants, and mixtures thereof.

10. The composition of claim 9 wherein the detergent surfactant is a mixture of a nonionic surfactant produced by the condensation of from about 5 moles to about 11 moles of ethylene oxide with one mole of a $C_{13}$ to $C_{16}$ alcohol, said nonionic surfactant being characterized by an HLB of from about 9.5 to about 15; and an anionic surfactant which is a mixture of an alkanolamine and an alkali metal salt of an alkyl benzene sulfonic acid where the alkyl group contains from about 9 to about 15 carbon atoms and wherein said alkanolamine is selected from the group consisting of mono-, di-, and triethanolamines and said alkali metal is selected from the group consisting of sodium, potassium, magnesium, and calcium; at a weight ratio of nonionic surfactant to anionic surfactant of from about 1.8:1 to about 3.5:1 based on the free acid form of the anionic surfactant.

11. The composition of claim 10 wherein the nonionic surfactant is a condensate of from about 6 to 9 moles of ethylene oxide with a $C_{14-15}$ alcohol and has an HLB within the range of 11 to 13, and the anionic surfactant is a mixture of the alkanolamine and the alkali metal salt of a $C_{10-13}$ alkyl benzene sulfonic acid.

12. The composition of claim 1 comprising from about 25% to about 50% of water.

* * * * *